United States Patent [19]

Davis et al.

[11] 4,456,143

[45] Jun. 26, 1984

[54] TAMPER RESISTANT FITMENT FOR A CONTAINER

[75] Inventors: Eugene E. Davis, Ilford; George W. Burton, London, both of England

[73] Assignee: Johnsen & Jorgensen (Plastics) Ltd., England

[21] Appl. No.: 510,623

[22] Filed: Jul. 5, 1983

[30] Foreign Application Priority Data

May 4, 1983 [GB] United Kingdom ..... 8312157

[51] Int. Cl.[3] ..... B65D 53/00; B65D 55/02

[52] U.S. Cl. ..... 220/214; 220/219; 220/270; 215/274

[58] Field of Search ..... 220/214, 270, 319; 215/256, 274, 275

[56] References Cited

U.S. PATENT DOCUMENTS

| | | | |
|---|---|---|---|
| 4,087,018 | 5/1978 | Tebbutt | 220/270 |
| 4,111,330 | 9/1978 | Jordan | 220/270 |
| 4,212,409 | 7/1980 | Jeppsson | 220/270 |
| 4,279,353 | 7/1981 | Honma | 215/274 |
| 4,376,493 | 3/1983 | Gall | 220/309 |

*Primary Examiner*—George T. Hall

*Attorney, Agent, or Firm*—Newton, Hopkins & Ormsby

[57] ABSTRACT

This invention provides a tamper-resistant fitment to convert a container which has a conventional cap or lid into a container which is tamper-resistant. The fitment has an outer rim member adapted to seat on the top edge of the container, an inner member to seat on the top of the cap, a plurality of grip tabs projecting from the outer rim member so as to extend downwardly along the outside of the container, a tension belt to hold the grip tabs in operative position and frangible means connecting the inner member to the outer rim member.

12 Claims, 9 Drawing Figures

Figure 5:
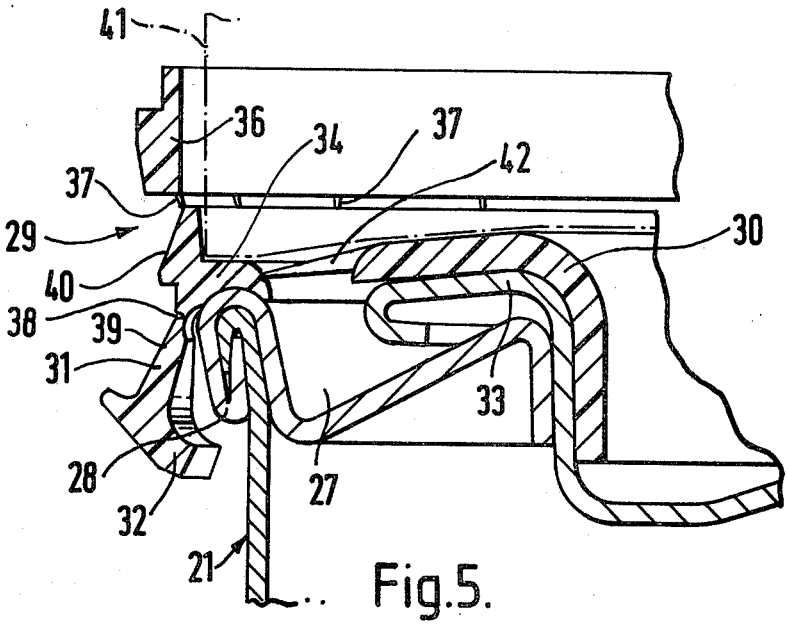

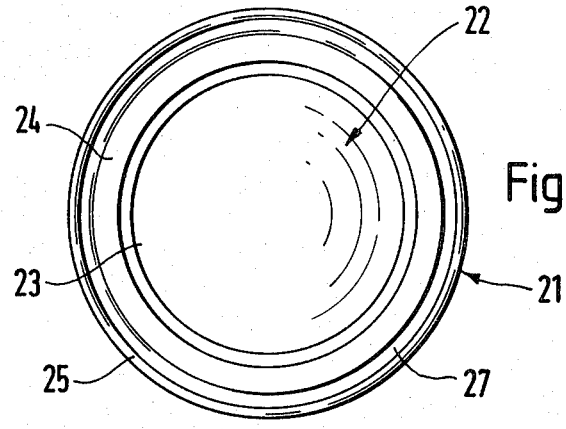
Fig.1.
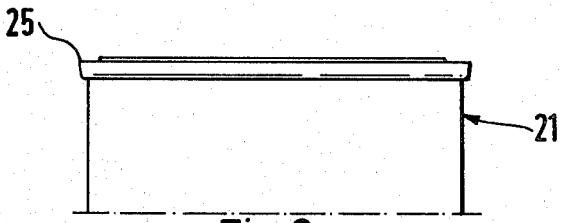
Fig.2.
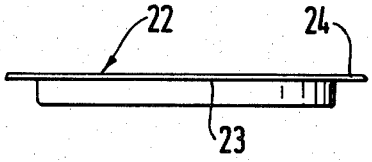
Fig.4.
Fig.3.
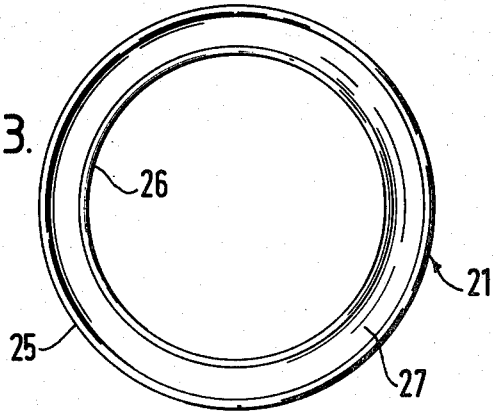

TAMPER RESISTANT FITMENT FOR A CONTAINER

This invention is concerned with the provision of a tamper resistant fitment for a container.

Many products are offered for sale in containers which comprise conventional container body and a conventional cap such as a simple push in cap. Examples of such conventional containers include paint tins and the traditional tins in which the well known product called Andrews Liver Salt is packed for sale. Hitherto such containers have not required any tamper resistant capability but recent events in U.S.A. have shown that in certain cases tamper resistance is desirable.

In accordance with a feature of the present invention there is provided a tamper-resistant fitment for a container with a conventional cap characterised in that the fitment comprises an outer rim member adapted to seat on the top edge of the container, an inner member to seat on the top of the cap, a plurality of grip tabs projecting from the rim member so as to extend downwardly along the outside of the container, gripping means on the grip tabs, a tension belt to hold the grip tabs in operative position, and frangible means connecting the inner member to the outer member. In one embodiment when in operative position the fitment covers the outer marginal edge of the container top and at least a part of the cap and spans a gap that is provided between the outer marginal edge of the cap and the outer marginal edge of the container. This gap is provided to receive a tool to lever off the cap when it is desired to open the container. The inner member is preferably an inner rim member but in accordance with a further feature of the invention the inner member may cover the cap substantially completely instead of being just an inner rim member. In accordance with another feature of the invention the tension belt may be in the form of a tamper-resistant tear ring connected to the outer rim member by frangible means. The arrangement of the tension belt may be such that the belt projects away from the container when the fitment is first applied to the container and the belt is then folded or telescoped downwards so that it embraces the grip tabs and forces the gripping means to engage with or press against the surface of the container with the gripping means engaged below an annular projection or lip on the container.

The invention may also be used with advantage in connection with forms of container, other than containers with push in caps, for example, tubular containers such as tubes made of relatively soft material including cardboard, fibreboard and the like. The invention therefore also includes a fitment in the form of a closure comprising a plug part to seat within an end of the tube, an outwardly projecting rim to seat on the end of the tube, a plurality of grip tabs projecting from the rim to extend along the outside of the tube, gripping means on the inside of the grip tabs and a tension belt preferably in the form of a tamper-resistant tear ring connected to the rim by frangible means, the arangement being such that the tamper-resistant ring projects away from the tube end when the fitment is first applied to the tube and that the ring is then telescoped, folded or snapped downwardly so that it embraces the grip tabs in the manner of a strap or belt and forces the gripping means to engage with the surface of the tube to prevent the closure being accidentally or otherwise removed until the tear ring is torn away.

Figure 6:
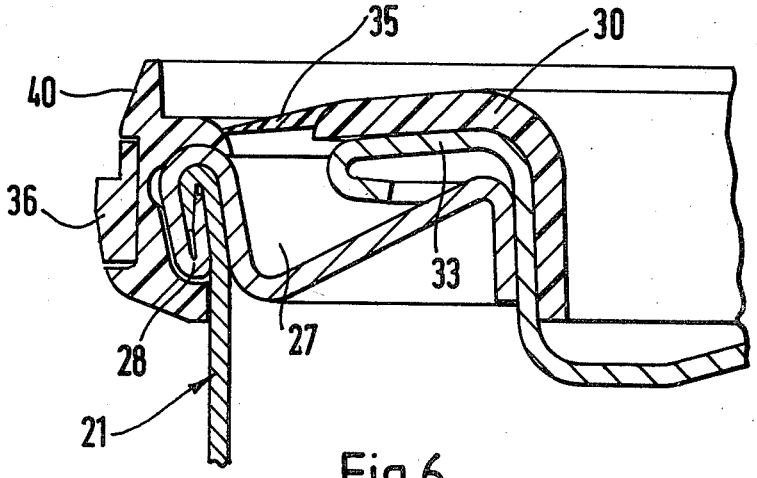
Figure 7:
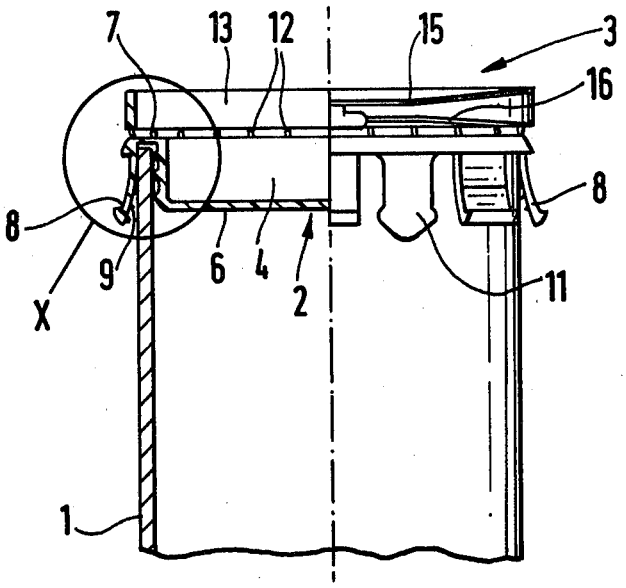
Figure 8:
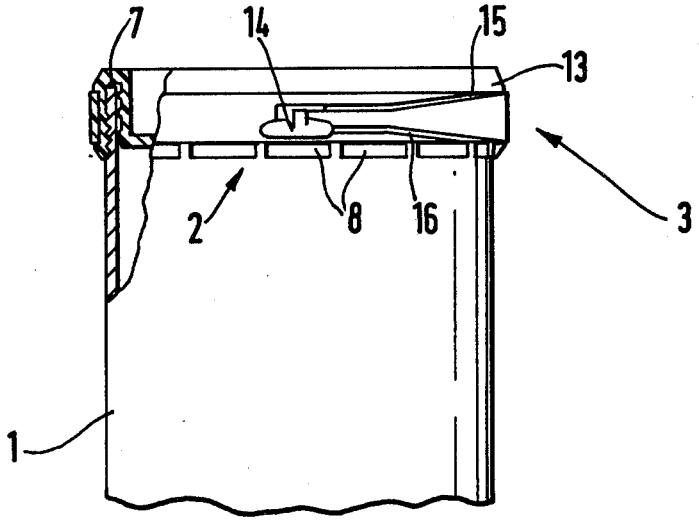
Figure 9:
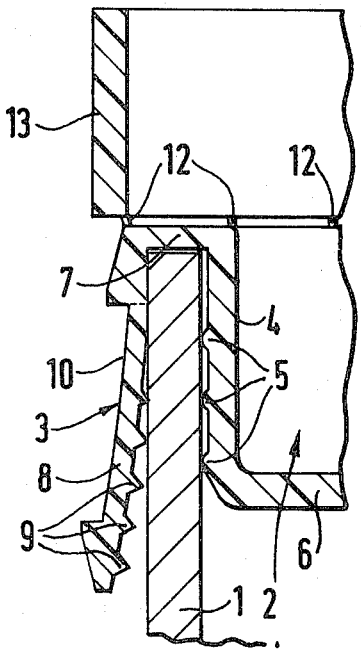

In order that the invention may be more clearly understood reference is now directed to the accompanying drawings given by way of example in which:

FIG. 1 is a top plan view of a conventional tin with a simple push in cap e.g. a liver salts tin with the cap on, FIG. 2. is a side view of the upper part of the tin illustrated in FIG. 1, FIG. 3 is a top plan view of the tin with the cap off, and FIG. 4 is a side view of the cap, FIG. 5 shows a cross-section of the upper part of the tin, FIG. 6 is a view with the fitment in a final position, FIG. 7 is a sectional view of a fitment with a closure including a tear ring, FIG. 8 is a view similar to FIG. 7 with the tamper proof tear ring in its operative position, FIG. 9 is an enlarged detail shown the part marked X in FIG. 7.

Referring first to FIGS. 1, 2, 3 and 4 it will be noted that the tin has a body indicated generally at 21 and a cap indicated generally at 22. The cap 22 has a centre part 23 forming a shallow internal plug and an annular outer flange 24. The body 21 has an outer top marginal edge 25, an inner top marginal edge 26 and an annular channel 27 between the edges 25 and 26. FIGS. 1 to 4 therefore simply show various views of a conventional tin which per se naturally forms no part of the present invention. These conventional tins have proved to be very satisfactory but to open them it is merely necessary to insert a tool into the channel 27 and to lever the cap off after which the cap can be replaced giving virtually no indication that the cap has ever been removed.

One object of this invention is to provide a simple and effective fitment, removal of which will indicate that the cap may have been removed so that the contents of the tin may have been tampered with. FIGS. 5 and 6 illustrate one embodiment of fitment applied to a tin as illustrated in FIGS. 1 to 4. FIG. 5 shows a cross-section of the upper part of the tin with the lid on and the fitment in a first position, and FIG. 6 is a view similar to FIG. 5 but with the fitment in a second or final position.

Referring to FIGS. 5 and 6 it will be noted that the body 21 is formed in two parts comprising a lower or container part with a bottom (not shown) and side walls and an upper part shaped in FIG. 5, to form the channel 27 and to provide an inwardly tapering outer annular lip 28.

The fitment, indicated generally by reference 29, has an annular inner rim member 30 seating on the top of the cap 33 and leaving substantially the whole of the centre part of the cap 33 uncovered and a plurality of grip tabs 31 projecting downwardly along the outside of the container 21 and each having a gripping projection or locking lug 32 at or near to its lower end to seat under the annular lip 28. The annular inner rim member 30 is of inverted V shape and is connected to an outer rim member 34 by frangible connections 35, with spaces 42 inbetween, spanning a gap between the inner rim member 30 and the outer rim member 34. If desired a depending projection, not shown, may be provided to fit into the channel 27. The inner rim member 30 may in the form of a complete disc-like cover for the lid.

The fitment is provided with an annular tension belt 36 preferably shaped as shown and connected to an annular pillar 40 projecting upwardly from the outer rim member 34, by a number of frangible nibs or connections 37. The outer rim member 34 and the grip tabs 31 meet at hinge point 38 and the outer rim member 34 and the grip tabs are shaped to provide a recess 39 to receive the belt 36. The pillar is shaped at 40 to form a lead ramp to assist the movement of the belt 36 from its first position (FIG. 5) to its second position (FIG. 6). Any desired and suitable number of frangible connections 35, frangible nibs 37 and grip tabs 31 may be provided and in one example we provide fifteen connections 35, thirty nibs 37 and fifteen tabs 31 each with a segmented locking lug 32. To complete the application of the fitment 29 to the container 21 the belt 36 is telescoped downwardly into the position shown in FIG. 6 thus breaking the nibs 37. The fitment is therefore applied to the closed tin by downward pressure until it assumes the position shown in FIG. 6 and this movement may be facilitated by the use of a sprung piston means, indicated generally at 41, to hold the rim members steady. When in the position shown in FIG. 6, it is almost impossible to remove the fitment or to open the tin by any other means without breaking the frangible connections 35. To facilitate removal of the fitment a tear away band with a finger and thumb grip in the form of a depending tab may be provided as described hereinafter in connection with FIGS. 7, 8 and 9. Alternatively the connections 35 may simply be broken, inner ring 30 with frangible connections 35 then being discarded having served their purpose and the lid 33 removed in the usual way. The outer ring and tension belt 36 remain captive on the rim of the tin for the life of the package. In addition a tear away band may be provided for example, as also described hereinafter in connection with FIGS. 7, 8 and 9 in which FIG. 7 is a sectional side elevation showing a fitment, in the form of a closure including a tear ring, in accordance with the invention in position on a tube end before the tamper proof tear ring is snapped into position, FIG. 8 is a view similar to FIG. 7 with the tamper proof tear ring in its operative position, and FIG. 9 is an enlarged detail showing the part marked X in FIG. 7, the section being taken through a grip tab.

In the drawings a tube 1 of carboard or the like has an open end 2 which is closed by means of a closure fitment 3 of plastic material such as polypropoylene or any other suitable material. The closure fitment has a plug part 4 which seats within the open end 2 of the tube 1 and which has a number of sealing rings 5 to make contact with the inside wall of the tube 1. In FIG. 7 the tube 1 is disposed vertically and the closure fitment 3 is applied to the top end of the tube 1 so that the wall of the plug part 4 is projecting downwards into the tube which is closed by the part 6.

The top of the plug part 4 in FIGS. 7, 8 and 9 has an outwardly projecting rim 7 which seats upon the edge of the tube 1 and extends beyond the outer edge of the tube. Depending from the rim 7 are a plurality of grip tabs 8. Each grip tab 8 has internal teeth 9 to serve as gripping members and a pocket, recess or the like 10 on the outside. There is also one finger and thumb grip tab 11 projecting downwardly from the rim 7; the tab 11 is not provided with teeth. The rim is connected by frangible nibs 12 or other suitable frangible means to a tamper resistant ring 13, which, before application of the closure fitment 3 to a tube 1, projects upwardly from the rim 7, see FIGS. 7 and 9. The tamper resistant ring 13 has a tear tab 14 and upper and lower tear membranes 15 and 16 which run out respectively to the top and the bottom of the tamper resistant ring.

When the closure fitment 3 is first applied to a tube the parts of the closure fitment are in the position shown in FIGS. 7 and 9 with the grip tabs 8 only lightly touching the outer surface of the tube. The parts of the closure fitment are then moved into the position shown in FIG. 8 by telescoping or folding over the ring 13 and snapping it into position in the pocket 10. When in this position, the pressure of the ring on the tabs causes the teeth 9 to bite into the outer surface of the tube so that the closure 3 cannot accidentally fall out of the end of the tube and cannot be removed by manual manipulation without first tearing away the ring 13. When it is desired to remove the closure fitment, a user grips the tab 14 and tears the ring away along the lines 15 and 16. The grips 8 can then be released manually from their gripping position and the closure fitment can be removed by lifting the tab 11. If necessary, the closure fitment can be replaced in position by pressing the plug 4 into the open end of the tube and then manually pushing the grip tabs back into position although this latter action would not be necessary in normal domestic or office use.

We have therefore provided a closure fitment for a board or other tube in which the closure fitment is retained in position by grip tabs which are caused to engage with the outer surface of the tube by an outer embracing tamper proof ring which is telescoped or folded over on to the grip tabs after the closure fitment has been applied to the tube, removal of the closure fitment then being impossible until the tamper proof ring is torn away.

As described above and illustrated in 5, 7 and 9 the closure fitment or tamper resistant fitment is moulded or otherwise formed as one integral unit but it will be understood that if desired the closure or tamper resistant fitment may be formed in two parts of the same or different meterial. In such an embodiment the upper part of the closure or tamper resistant fitment may be made as a separate unit from the lower part. This is a less economical method of manufacture but is more versatile in design and choice of materials to be used.

In the above description relating to FIGS. 7, 8 and 9 we have referred particularly to the use of the fitment as a closure for a container which in the form of a tube but it will be understood that without modification the fitment as described can be used as a closure fitment for a tubular container. On the other hand the fitment described in connection with FIGS. 5 and 6 cannot be used as a closure fitment without modification owing to the presence of the gaps 42. To modify the fitment of FIGS. 5 and 6 for use as a closure fitment the frangible connections 35 and gaps 42 may be provided in an annular skirt projecting downwardly from the top of the fitment to which skirt the grip tabs may be connected.

In FIGS. 7, 8 and 9 the gripping means on the grip tabs bite into the surface of the tube and in FIGS. 5 and 6 the gripping means engage below the lip 28. When the fitment is used with a tubular container of plastics or other material having a smooth and relatively hard surface the gripping means cannot bite into or engage with the container and in wuch cases other engaging means may be used such as adhesive pads on the tabs.

We claim:

1. A tamper-resistant fitment for a container with a conventional cap characterised in that the fitment comprises an outer rim member adapted to seat on the top edge of the container, an inner member to seat on the top of the cap, a plurality of grip tabs projecting from the outer rim member so as to extend downwardly along the outside of the container, a tension belt to hold the grip tabs in operative position and frangible means connecting the inner member to the outer rim member.

2. A fitment according to claim 1 characterised in that the inner member is in the form of an annular rim leaving the central part of the cap uncovered, or is in the form of a complete disc covering the central part of the cap.

3. A fitment according to claim 1 characterised in that the tension belt is in the form of a tamper-resistant tear ring connected to the outer rim member by frangible means.

4. A fitment according to claim 3 and further characterised in that the tension belt projects away from the container when the fitment is first applied to the container and that the belt is then folded or telescoped downwards so that it embraces the grip stabs.

5. A fitment in the form of a closure comprising a plug part to seat within an end of a tubular container, an outwardly projecting rim to seat on the end of the tube, a plurality of grip tabs projecting from the rim to extend along the outside of the tube, gripping means on the inside of the grip tabs and a tension belt in the form of a tamper-resistant tear ring connected to the rim by frangible means, the arrangement being such that the tamper-resistant ring projects away from the tube end when the fitment is first applied to the tube and that the ring is then telescoped, folded or snapped downwardly so that it embraces the grip tabs in the manner of a strap or belt and forces the gripping means to engage with the surface of the tube.

6. A fitment according to claim 1 characterised in that the grip tabs are each provided with a gripping projection or locking lug.

7. A fitment according to claim 1 characterised in that the inner member is of inverted V shape and is connected to the outer member by frangible connections.

8. A fitment according to claim 1 and further characterised in that the tension belt is, in a first position, connected to an annular pillar projecting from the outer rim member by a number of frangible ribs.

9. A fitment according to claim 8 characterised in that the outer rim member and the grip tabs meet at a hinge point.

10. A fitment according to claim 8 and further characterised in that the outer rim member and the grip tabs are shaped to provide a recess to receive the tension belt when in its final position.

11. A fitment according to claim 10 characterised in that the pillar is shaped to form a lead ramp to facilitate movement of the belt to its final position.

12. A tamper-resistant fitment for a conventional container characterised in that the fitment has a cover member to seat on an open end of the container, a plurality of grip tabs depending from the cover member, gripping means at or near to the end of each grip tab and frangible means in which have to be broken, in order to open the container, when the fitment has been applied to the container.

* * * * *